US006425310B1

(12) United States Patent
Champion

(10) Patent No.: US 6,425,310 B1
(45) Date of Patent: Jul. 30, 2002

(54) MUZZLE BRAKE

(76) Inventor: Edwin J. Champion, 5300 S. Priest, Tempe, AZ (US) 85203

( * ) Notice: Subject to any disclaimer, the term of this patent is extended or adjusted under 35 U.S.C. 154(b) by 0 days.

(21) Appl. No.: 09/780,749

(22) Filed: Feb. 9, 2001

(51) Int. Cl.[7] ..... F41A 21/00
(52) U.S. Cl. ..... 89/14.3; 89/14.4
(58) Field of Search ..... 89/14.3, 14.4; 42/79, 1.06

(56) References Cited

U.S. PATENT DOCUMENTS

| | | | | | |
|---|---|---|---|---|---|
| 1,017,003 | A | * | 2/1912 | Kenney | 181/223 |
| 1,087,397 | A | * | 2/1914 | Persson | 181/236 |
| 1,111,202 | A | * | 9/1914 | Westfall | 181/223 |
| 1,173,687 | A | * | 2/1916 | Thompson | 181/223 |
| 1,229,675 | A | * | 6/1917 | Thompson | 89/14.3 |
| 1,773,443 | A | * | 8/1930 | Wilman | 89/14.4 |
| 3,667,570 | A | * | 6/1972 | WerBell, III | 181/223 |
| 3,677,132 | A | * | 7/1972 | Plenge | 42/1.14 |
| 3,713,362 | A | * | 1/1973 | Charron | 89/14.4 |
| 4,291,610 | A | * | 9/1981 | Waiser | 89/14.4 |
| 4,530,417 | A | * | 7/1985 | Daniel | 181/223 |
| 4,576,083 | A | * | 3/1986 | Seberger, Jr. | 181/223 |
| 4,584,924 | A | * | 4/1986 | Taguchi | 181/223 |
| 4,588,043 | A | * | 5/1986 | Finn | 181/223 |
| 5,164,535 | A | * | 11/1992 | Leasure | 181/223 |
| 6,079,311 | A | * | 6/2000 | O'Quinn et al. | 42/79 |

FOREIGN PATENT DOCUMENTS

| | | | | | |
|---|---|---|---|---|---|
| FR | 00919451 | A1 | * | 3/1947 | 89/14.3 |
| GB | 00006701 | A1 | * | 11/1899 | 89/14.3 |
| GB | 00030240 | A1 | * | 12/1910 | 89/14.3 |

* cited by examiner

*Primary Examiner*—Michael J. Carone
*Assistant Examiner*—Denise J Buckley
(74) *Attorney, Agent, or Firm*—Cahill, Sutton & Thomas P.L.C.

(57) ABSTRACT

An assemblage of members held in a sleeve form a series of plenums which each have a reaction wall surface against which propulsion gasses generate anti recoil forces. Vents from the plenums direct propulsion gasses upwardly and outwardly to further counter recoil forces.

11 Claims, 1 Drawing Sheet

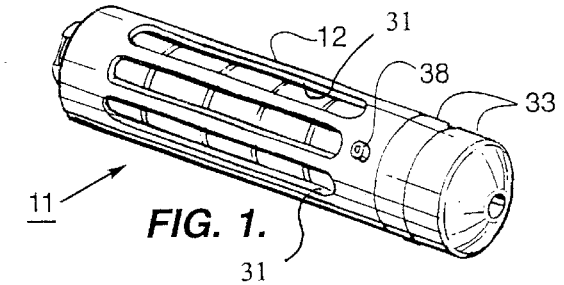
FIG. 1.
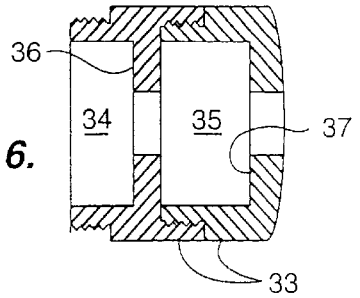
FIG. 6.
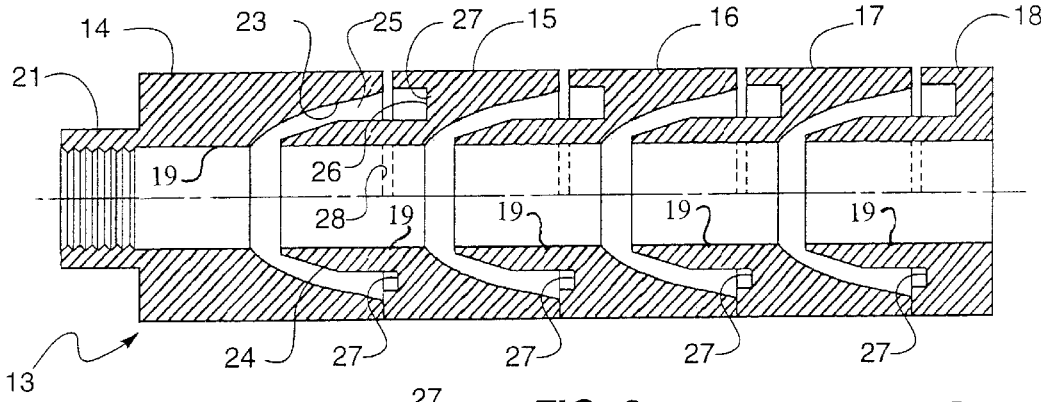
FIG. 2
FIG. 4.
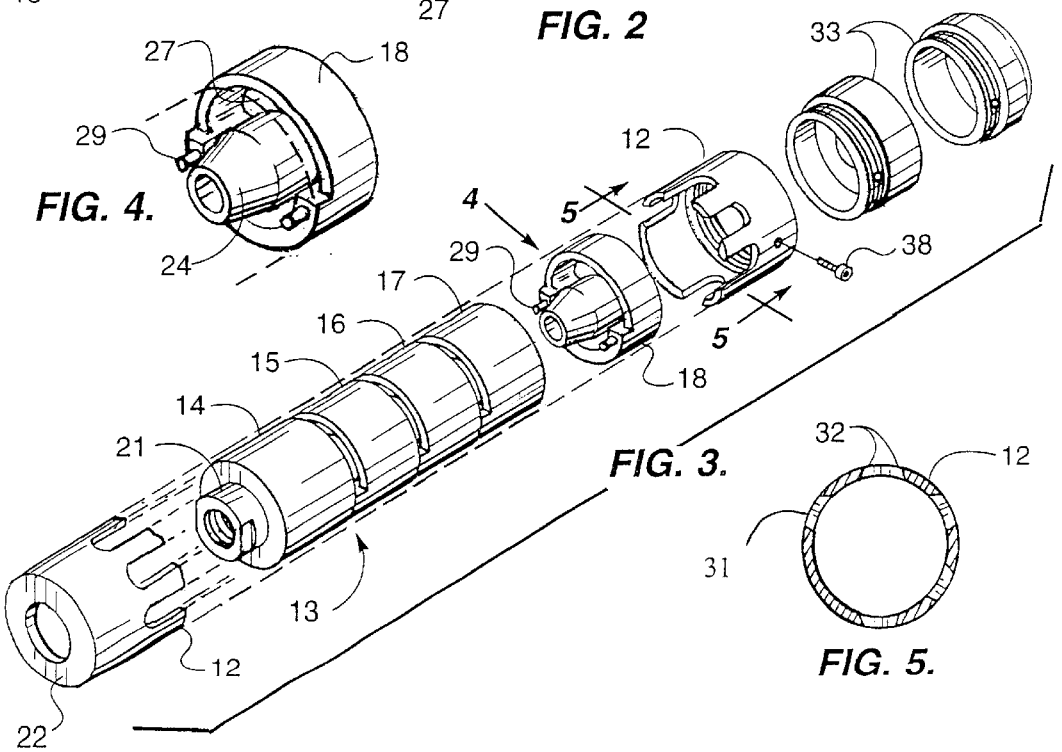
FIG. 3.
FIG. 5.

MUZZLE BRAKE

TECHNICAL FIELD

This invention relates to an improved muzzle brake for attachment to the muzzle of a gun.

BACKGROUND ART

The recoil of a gun severely interferes with the accuracy of firing at a target. A hand-held gun, such as a rifle, will tend to kick up and often to one side causing the gun to walk up and away from the target.

The recoil problem is particularly acute with fully automatic weapons, such as the Army's M14 rifle. As a consequence the United States military has virtually discontinued use of that weapon in favor of smaller caliber rifles in spite of the latter exhibiting lesser firepower.

In the past muzzle brakes have been designed to a variety of configurations. Representative of these are the muzzle brakes disclosed in the following United States patents: U.S. Pat. No. 1,333,402 granted to N. J. A. Galliot et al on Mar. 9, 1920 for "Arrangement for Deadening the Recoil of Firearms and the Like"; U.S. Pat. No. 2,567,826 granted to J. E. Prache on Sep. 11, 1951 for "Muzzle Recoil Check for Firearms"; U.S. Pat. No. 5,036,747 granted to H. T. McClain III on Aug. 6, 1991 for "Muzzle Brake"; and U.S. Pat. No. 5,476,028 granted to O. P. Seberger on Dec. 19, 1995 for "Gun Muzzle Brake". As with many other brakes, recoil is reduced with these brakes by directing the propulsion gasses rearwardly from the brake and back into the face of the user of the weapon and nearby companions. This phenomenon can be characterized as "back blast". They also offer the disadvantage of presenting a large and highly visible flash signature for the weapon. Further, these prior brakes do very little by way of suppressing the noise signature of the weapon. All of these features are of considerable importance to the military.

SUMMARY OF THE INVENTION

Unlike the prior brakes mentioned above, in the brake of this invention the anti recoil forces are generated in a series of lengthy plenums having reaction wall surfaces therein. A nose piece having additional reaction surfaces therein generates additional anti recoil forces.

The plenums are provided by an assemblage of plenum forming members each having a forward face and a rear face and an axial bore therethrough. Each member has a conical-like recess in the forward face thereof and a conical-like projection on the rear face thereof. The members are assembled with the forward face of one member in contact with the rear face of an adjoining member whereby the recess in one member receives the projection of an adjoining member. Thus, there is created between adjoining members a generally annular plenum which is open at its inner end to the bore through the members for admitting propulsion gasses passing through the bore. Each plenum is further defined as its outer end by a reaction wall surface on the rear surface of an adjoining member. And finally the members are further configured to provide a vent for each plenum, preferably primarily in the upper region of the assemblage of members.

In addition to generating anti recoil forces the plenums contain the propulsion gasses for a sufficient period to allow substantially complete powder bum thereby reducing the flash signature of the weapon. The same is also true of the nose piece. Because of the confinement of the propulsion gasses, albeit for a limited period, the explosion sound leaving the brake is suppressed thereby reducing the noise signature of the weapon.

BRIEF DESCRIPTION OF THE DRAWINGS

The invention is described in greater detail hereafter by reference to the accompanying drawing wherein:

FIG. 1 is a perspective view of a nozzle brake embodying the invention;

FIG. 2 is a vertical sectional view through an assemblage of plenum forming members in the brake;

FIG. 3 is an exploded view of the brake with portions broken away;

FIG. 4 is an enlarged perspective view of one of the plenum forming members in the brake;

FIG. 5 is a sectional view of a sleeve for holding the plenum forming members taken as indicated by line 5—5 in FIG. 3; and FIG. 6 is a sectional view of the nose piece of the brake.

BEST MODES FOR CARRYING OUT THE INVENTION

The muzzle brake of this invention is designated generally by reference numeral 11. The brake comprises a sleeve 12 which houses an assemblage 13 of plenum forming members 14, 15, 16, 17 and 18. All of the plenum forming members have an axial bore 19 therethrough for passage of a projectile (not shown) and propulsion gasses.

Rearmost plenum forming member 14 has a threaded rear projection 21 which extends through an opening in the rear end wall 22 of sleeve 12. Projection 21 is adapted to be screwed onto a threaded muzzle (not shown) of a weapon, such as a rifle. Member 14 of the assemblage 13 has a conical-like recess 23 in its forward face.

Assemblage member 15 has a conical-like projection 24 on its rear wall and that projection is received in the recess 23 in member 14. Recess 23 and projection 24 form therebetween an annular plenum, or chamber, 25 which is open at its inner end to the bore 19 for admitting propulsion gasses passing through the bore into the plenum. The outer, or forward end of the plenum 25 terminates in an annular recess 26 in the rear face of member 15 which provides a reaction wall surface 27. Propulsion gasses striking the reaction wall surface 27 generate anti recoil forces.

The reaction wall surface 27 for each of the plenum forming members 15, 16, 17 and 18 has a larger area across the top of the member than across the bottom of the member. It is believed that this greater area generates greater reaction forces in the upper portion of the brake, which forces tend to hold the brake and weapon down.

A vent slot, or gap, 28 is provided between adjoining surfaces of plenum forming members 14 and 15. The vent slot 28 extends approximately 180° around the upper region of the assemblage 13. Thus gasses exiting plenum 25 through the vent slot 28 are directed upwardly and outwardly from the brake 11 generating additional reaction forces opposing the recoil force tending to walk the muzzle of the weapon upwardly and to the side.

This configuration between adjoining members 15, 16, 17 and 18 is continued throughout the assemblage 13 so that a series of plenums 25 are provided along the assemblage. As many plenum forming members may be employed as are required to generate the desired anti recoil forces.

It is to be noted that the plenums 25 are elongated and rather confined with lower regions of the plenums venting only through the vent slots in the upper region of the brake. This construction provides additional bum time for powder in the propulsion gasses and significantly cuts down the flash signature from the weapon. Militarily this is important because flash from a rifle reveals the soldier's location to the enemy.

A further benefit of the construction of the plenums 25 is a reduction in the explosive sound emitted from the brake. This is important not only to the soldier firing the weapon, but to companions nearby.

And because the propulsion gasses exit the plenums 25 through vent slots 28 the gasses are not directed rearwardly and back blast is avoided for the safety and comfort of the soldier and companions.

It is desired that alignment means be provided between members 15 and 16, 16 and 17, and 17 and 18. As best shown in FIGS. 3 and 4 the alignment may take the form of alignment pins 29 provided on a face of one member for entering alignment bores on the face of an adjoining member. No such alignment means is provided between members 15 and 14 because member 14 must be free to turn in sleeve 12 for attaching the brake to the muzzle of a weapon while keeping the vent slots 28 properly oriented.

It is to be noted that the sleeve 12 of the brake is provided with a plurality of openings 31 to permit propulsion gasses to escape from the brake. These openings 31 are preferably longitudinal slots as shown in FIG. 1 and are preferably chambered as indicated at 32 in FIG. 5 to expose more of the area of the vent slots 28 and to segment exiting gasses to break up any flash signature.

The assemblage 13 of plenum forming members 14, 15, 16, 17 and 18 is held in place in sleeve 12 by a nose piece 33 threadably received in the forward end of the sleeve. Nose piece 33 is preferably hollow and formed in two pieces so as to provide two final propulsion gas expansion chambers, or plenums, 34 and 35 with reaction wall surfaces 36 and 37 to further reduce recoil, flash and noise. See FIG. 6. A set screw 38 can be employed to lock the nose piece against turning and becoming loose.

Although the plenum forming members and the retainer sleeve illustrated have cylindrical configurations, and that is preferred for ease of manufacture, these elements could possess non-circular cross-sections if for some reason that is desired.

What is claimed is:

1. A gun muzzle brake having an axis and a rear or muzzle end and a forward or exit end, said muzzle brake being adapted to be affixed to a muzzle of a gun barrel as a coaxial extension thereof comprising an assemblage of plenum forming members each having a forward face and rear face and being assembled with the forward face of one member in direct contact with the rear face of an adjoining member, each such member further having:

a) an axial bore therethrough;

b) a conical-like recess in the forward face thereof; and c) a conical-like projection on the rear face thereof;

the conical-like recess in one member receiving the conical-like projection of an adjoining member whereby an annular plenum is provided between the recess and the projection of each pair of adjoining members;

each such plenum being open at its inner end to the bore through the members for admitting gasses passing through the bore and being defined at its outer end by a reaction wall surface on the rear surface of the adjoining member;

d) and said members are further configured to provide a vent for gasses in each plenum.

2. The muzzle brake of claim 1 further characterized in that the assemblage of plenum forming members has an upper region and a lower region and said members are configured to provide the vents primarily in the upper region of the assemblage.

3. The muzzle brake of claim 1 further comprising an elongated sleeve having openings in the wall thereof and said assemblage of plenum forming members is disposed in the sleeve.

4. The muzzle brake of claim 3 wherein the openings in the wall of said sleeve are slots extending longitudinally of the sleeve.

5. The muzzle brake of claim 1 further characterized in that said plenum forming members have a cylindrical external configuration.

6. The muzzle brake of claim 5 further comprising an elongated cylindrical sleeve having openings in the wall thereof and said assemblage of plenum forming members is disposed in the sleeve.

7. The muzzle brake of claim 1 further comprising interlocking means at the faces of said plenum forming members for preventing relative rotational movement of adjoining members about the bore axis.

8. The muzzle brake of claim 5 further comprising interlocking means at the faces of said plenum forming members for preventing relative rotational movement of adjoining members about the bore axis.

9. The muzzle brake of claim 6 further comprising interlocking means at the faces of said plenum members for preventing relative rotational movement of adjoining members about the bore axis.

10. The muzzle brake of claim 2 further characterized in that said reaction wall surface has a greater area in the upper region of the members than in the lower region of the members.

11. The muzzle brake of claim 1 further comprising a nose piece at the forward end of the brake and having a pair of expansion chambers therein.

* * * * *